US010804609B1

(12) United States Patent
Nosrati et al.

(10) Patent No.: US 10,804,609 B1
(45) Date of Patent: Oct. 13, 2020

(54) CIRCULAR POLARIZATION ANTENNA ARRAY

(71) Applicant: Facebook, Inc., Menlo Park, CA (US)

(72) Inventors: Mehrdad Nosrati, Redmond, WA (US); Gordon Michael Coutts, Woodinville, WA (US)

(73) Assignee: Facebook, Inc., Menlo Park, CA (US)

( * ) Notice: Subject to any disclaimer, the term of this patent is extended or adjusted under 35 U.S.C. 154(b) by 0 days.

(21) Appl. No.: 16/543,487

(22) Filed: Aug. 16, 2019

Related U.S. Application Data

(60) Provisional application No. 62/878,331, filed on Jul. 24, 2019.

(51) Int. Cl.
*H01Q 9/04* (2006.01)
*H01Q 21/06* (2006.01)
*H01Q 19/00* (2006.01)

(52) U.S. Cl.
CPC ..... *H01Q 9/0428* (2013.01); *H01Q 19/005* (2013.01); *H01Q 21/065* (2013.01)

(58) Field of Classification Search
CPC ..... H01Q 9/04; H01Q 9/0407; H01Q 9/0428; H01Q 9/0435; H01Q 9/045; H01Q 9/0492; H01Q 19/005; H01Q 21/06; H01Q 21/061; H01Q 21/065; H01Q 21/24; H01Q 5/30; H01Q 5/378; H01Q 5/385; H01Q 5/392
See application file for complete search history.

(56) References Cited

U.S. PATENT DOCUMENTS 4,780,724 A * 10/1988 Sharma ..... H01Q 9/0442 333/104
4,843,400 A * 6/1989 Tsao ..... H01Q 9/0428 343/700 MS
5,241,321 A * 8/1993 Tsao ..... H01Q 9/0435 343/700 MS (Continued)

OTHER PUBLICATIONS

Compact Wideband Circularly Polarized Microstrip Antenna Array for 45 GHz Application; Zheng Gan, Zhi-Hong Tu , le-Ming Xie, Qing-Xin Chu , and Yue Yao, IEEE Transactions on Antennas and Propagation, vol. 66, No. 11, Nov. 2018.

(Continued)

*Primary Examiner* — Jason Crawford
(74) *Attorney, Agent, or Firm* — Brian R. Short

(57) ABSTRACT

Apparatuses, methods, and systems for an antenna element are disclosed. For an embodiment, the antenna element includes a feed line layer, a first substrate adjacent to the feed line layer, a ground layer adjacent to the first substrate, a second substrate adjacent to the ground layer, and a third layer adjacent to the second substrate. The feed line layer includes a conductive fork-shape that includes a conductive handle adapted to be electrically connected to a center conductor of a coaxial line, a conductive cross-section that crosses an end portion of the conductive handle, and a plurality of conductive fingers. For an embodiment, a rectangular slot is formed in the ground layer, wherein a length of the rectangular slot is perpendicular to the conductive handle. For an embodiment, the third layer includes four parasitic elements, wherein each parasitic element is electrically connected to the ground layer through a shorting via.

20 Claims, 10 Drawing Sheets

(56) References Cited

U.S. PATENT DOCUMENTS

| | | | | |
|---|---|---|---|---|
| 5,534,877 | A * | 7/1996 | Sorbello | H01Q 21/061 343/700 MS |
| 5,661,494 | A * | 8/1997 | Bondyopadhyay | H01Q 1/364 343/700 MS |
| 6,018,319 | A * | 1/2000 | Lindmark | H01Q 9/0435 343/700 MS |
| 6,989,793 | B2 * | 1/2006 | Van Der Poel | H01Q 9/0414 343/700 MS |
| 8,519,891 | B2 * | 8/2013 | Chen | H01Q 21/0075 343/700 MS |
| 9,391,375 | B1 | 7/2016 | Bales et al. | |
| 9,472,849 | B2 * | 10/2016 | Shin | H01Q 9/0414 |
| 9,755,306 | B1 * | 9/2017 | Ogilvie | H01Q 9/0414 |
| 9,755,311 | B2 | 9/2017 | Zhou et al. | |
| 9,923,267 | B1 * | 3/2018 | Pala | H01Q 9/065 |
| 2006/0132359 | A1 * | 6/2006 | Chang | H01Q 9/0428 343/700 MS |
| 2012/0098706 | A1 * | 4/2012 | Lin | H01Q 21/065 343/700 MS |
| 2012/0162015 | A1 * | 6/2012 | Chen | H01Q 9/0457 343/700 MS |
| 2012/0313832 | A1 | 12/2012 | Pazin et al. | |
| 2015/0318618 | A1 * | 11/2015 | Chen | H01Q 3/443 343/750 |
| 2016/0056541 | A1 * | 2/2016 | Tageman | H01P 3/16 343/771 |
| 2017/0288313 | A1 * | 10/2017 | Chung | H01Q 21/005 |
| 2019/0131710 | A1 | 5/2019 | Pan et al. | |

OTHER PUBLICATIONS

60-GHz Circularly Polarized U-Slot Patch Antenna Array on LTCC; Hucheng Sun, Yong-Xin Guo, and Ziliang Wang; IEEE Transactions on Antennas and Propagation, vol. 61, No. 1, Jan. 2013.

A60-GHzCircularly-PolarizedArrayAntenna-in-Package in LTCC Technology; Wenmei Zhang, Y. P. Zhang, Mei Sun, Cyril Luxey, Diane Titz, and Fabien Ferrero;IEEE Transactions on Antennas and Propagation, vol. 61, No. 12, Dec. 2013.

An Integrated Wide-Band Circularly Polarized Antenna for Millimeter-Wave Applications; Mohammad Fakharzadeh and Mehrbod Mohajer;IEEE Transactions on Antennas and Propagation, vol. 62, No. 2, Feb. 2014.

A New Circularly Polarized Monopole Antenna for 60 GHz Communications; Dia'aaldin Bisharat, Shaowei Liao, and Quan Xue; Proceedings of iWEM 2014, Sapporo, Japan © 2014 IEEE 173.

Wideband Unidirectional Circularly Polarized Antenna With L-Shaped Radiator Structure; Dia'aaldin J. Bisharat, Student Member, IEEE, Shaowei Liao, Member, IEEE, and Quan Xue, Fellow, IEEE; IEEE Antennas and Wireless Propagation Letters, vol. 16, 2017.

Broadband Circularly Polarized Patch Antenna Arrays With Multiple-Layers Structure; Hau Wah Lai, Senior Member, IEEE, Di Xue, Hang Wong, Senior Member, IEEE, Kwok Kan So, Senior Member, IEEE, and Xiu Yin Zhang, Senior Member, IEEE; IEEE Antennas and Wireless Propagation Letters, vol. 16, 2017.

A Novel Widebeam Planar Patch Antenna for WLAN Applications; Xiang Shuai, Shaoquiu Xiao, Xing Fan, Cheng Gong, IEEE 2016.

Study on Wide-Angle Scanning Linear Phased Array Antenna; Guangwei Yang , Jianying Li , Dujuan Wei , and Rui Xu; IEEE Transactions on Antennas and Propagation, vol. 66, No. 1, Jan. 2018.

An Integrated Circularly Polarized Transmitter Active Phased-Array Antenna for Emerging Ka-Band Satellite Mobile Terminals; Hussam Al-Saedi, Member, IEEE, Wael M. Abdel-Wahab, Mohsen Raeis-Zadeh, Ehsan Alian, Ardeshir Palizban, Ahmad Ehsandar, Naimeh Ghafarian, Guoyan Chen, Soroush Rasti Boroujeni, Mohammad-Reza Nezhad-Ahmadi, and Safieddin Safavi-Naeini; IEEE Transactions on Antennas and Propagation 2018.

Z-Shaped Monopole Antenna for Wideband Circularly Polarized Radiation; Benyang Hu, Nasimuddin, and Zhongxiang Shen; 2013 Asia-Pacific Microwave Conference Proceedings.

* cited by examiner

| Parameter | Value |
|---|---|
| $L_1$ | $(\lambda_{min})/2$ |
| $L_2$ | $(\lambda_{min})/2$ |
| $L_3$ | $(\lambda_{min})/8$ |
| $L_4$ | $(\lambda_{mid})/2$ |
| $L_5$ | $(\lambda_{mid})/2$ |
| $W_{feed}$ | Example Value of 0.3 mm |

| Parameter | Value |
|---|---|
| $L_6$ | $(\lambda_{min})/10$ |
| $L_7$ | $(\lambda_{min})/4$ |

| Parameter | Value |
|---|---|
| $L_8$ | $(\lambda_{mid})/2$ |
| $L_9$ | $(\lambda_{min})/8$ |
| $L_{10}$ | $(\lambda_{min})/2$ |
| $H_{slot}$ | $(\lambda_{mid})/2$ |

| Parameter | Value |
|---|---|
| $L_{11}$ | $(\lambda_{max})/2$ |
| $L_{12}$ | $(\lambda_{min})/10$ |
| $L_{13}$ | $(\lambda_{min})/4$ |
| $L_{14}$ | $(\lambda_{max})/4$ |
| $W_1$ | $(\lambda_{min})/10$ to $(\lambda_{max})/10$ |

| Parameter | Value |
|---|---|
| $L_{15}$ | $(\lambda_{mid})/2$ |
| $L_{16}$ | $(\lambda_{min})/8$ |
| $R_1$ | $(\lambda_{max})/4$ |
| $R_2$ | $(\lambda_{min})/4$ |
| $W_2$ | $(\lambda_{min})/10$ to $(\lambda_{max})/10$ |

CIRCULAR POLARIZATION ANTENNA ARRAY

RELATED APPLICATIONS

This patent application claims priority to U.S. Patent Application Ser. No. 62/878,331 filed Jul. 24, 2019, which is herein incorporated by reference.

FIELD OF THE DESCRIBED EMBODIMENTS

The described embodiments relate generally to wireless communications. More particularly, the described embodiments relate to systems, methods and apparatuses for an antenna element of a circular polarization antenna array.

BACKGROUND

Wireless communication involves the propagation of electromagnetic waves from one or more antennas of a transmitter to one or more antennas of a receiver. However, most antennas simply radiate a linear polarization electromagnetic wave.

It is desirable to have methods, apparatuses, and systems for antenna elements of an antenna array that facilitate the generation of circular polarized wireless beams.

SUMMARY

An embodiment includes an antenna element. For an embodiment, the antenna element includes a feed line layer, a first substrate adjacent to the feed line layer, a ground layer adjacent to the first substrate, a second substrate adjacent to the ground layer, and a third layer adjacent to the second substrate. The feed line layer includes a conductive fork-shape that includes a conductive handle adapted to be electrically connected to a center conductor of a coaxial line, a conductive cross-section that crosses an end portion of the conductive handle, and a plurality of conductive fingers, a conductive finger connected to each end portion of the conductive cross-section, and a conductive finger connected to a center portion of the conductive cross-section. For an embodiment, a rectangular slot is formed in the ground layer, wherein a length of the rectangular slot is perpendicular to the conductive handle. For an embodiment, the third layer includes four parasitic elements, wherein each parasitic element is electrically connected to the ground layer through a shorting via.

Another embodiment includes an antenna array. For an embodiment, the antenna array includes a plurality of antenna elements organized into rows and columns.

Another embodiment includes wireless transceiver. For an embodiment, the wireless transceiver includes an antenna array, a radio, and a controller. For an embodiment, the antenna array includes a plurality of antenna elements, and operates to form a circular polarized directional beam. For an embodiment, the radio is connected to the antenna array. For an embodiment, the controller operates to control the reception and transmission of wireless signals wireless signals through the radio and through the circular polarized beam formed by the antenna array.

Other aspects and advantages of the described embodiments will become apparent from the following detailed description, taken in conjunction with the accompanying drawings, illustrating by way of example the principles of the described embodiments.

DESCRIPTION

The embodiments described include methods, apparatuses, and systems for an antenna element. At least some embodiments of the antenna element are adapted for forming a circular polarization phased-array antenna. The antenna elements are configured to control (reduce) coupling between the antenna elements of the antenna array, and operate to form circular polarization electric fields.

Figure 1:
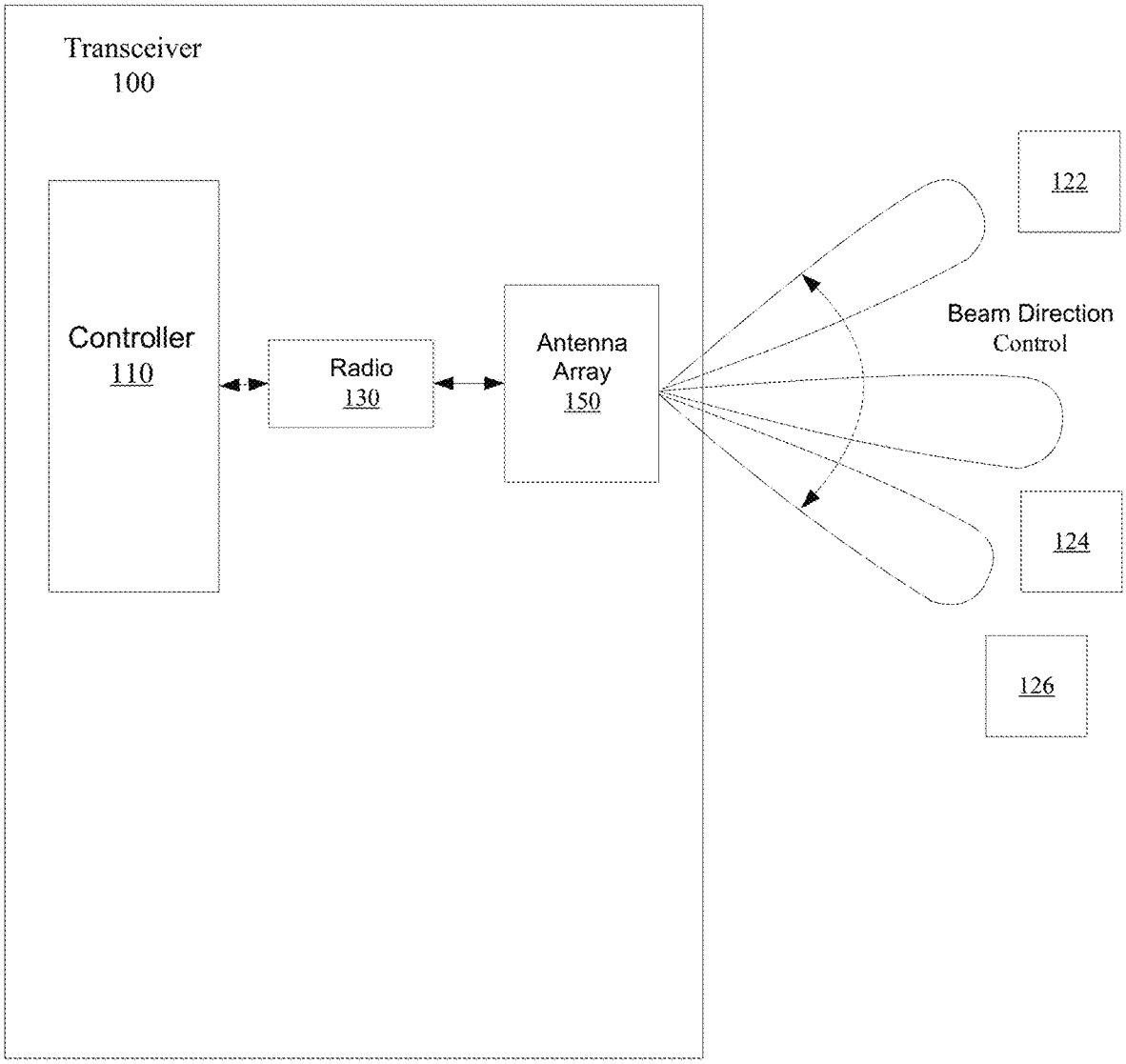
FIG. 1 shows a transceiver wirelessly communicating with a plurality of different devices, according to an embodiment.

FIG. 1 shows a transceiver 100 wirelessly communicating with a plurality of different devices 122, 124, 126, according to an embodiment. For an embodiment, the transceiver includes a controller 110, a radio 130, and an antenna array 150. The antenna array 150 is controllable to form a directional beam that allows the transceiver 100 to wirelessly communicate with the plurality of different devices 122, 124, 126. For an embodiment, a direction of the beam formed by the antenna array 150 is controlled by controlling a phase and/or amplitude of signals passing through each antenna element of the antenna array 150.

Figure 2:
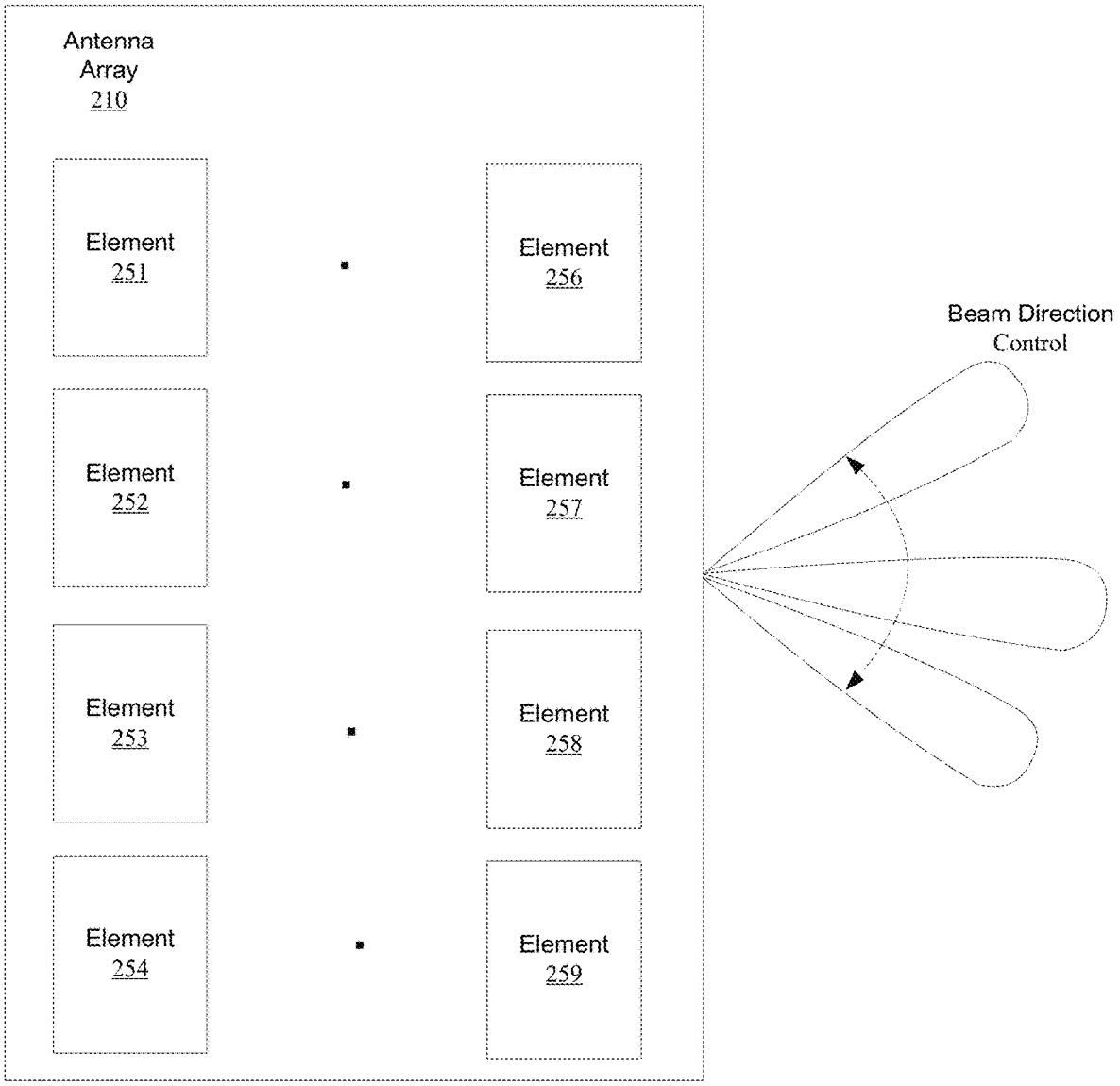
FIG. 2 shows an antenna array, according to an embodiment.

FIG. 2 shows an antenna array 210, according to an embodiment. For an embodiment, the antenna array 210 includes a plurality of antenna elements 251-259. For an embodiment, the antenna elements 251-259 of the antenna array 210 are organized into rows a columns. Further, as previously described, the antenna elements 251-259 of the antenna array 210 operate to form a beam based on phase and amplitude adjustments of signals being communicated through the antenna elements 251-259.

Figure 3:
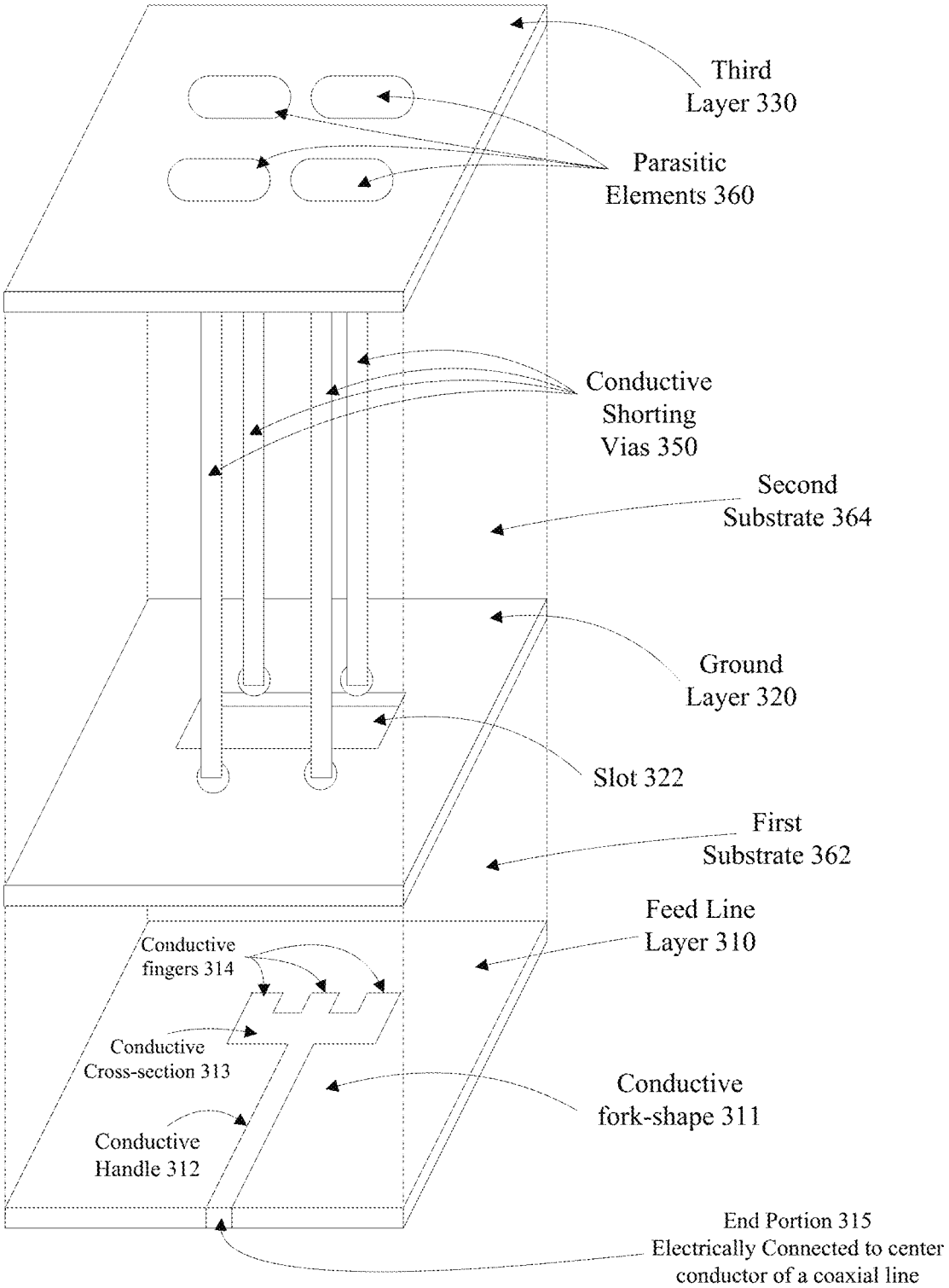
FIG. 3 shows an antenna element, according to an embodiment.

FIG. 3 shows an antenna element, according to an embodiment. For an embodiment, the antenna element includes a feed line layer 310, a ground layer 320, and a third layer 330. Further, the antenna element includes a first substrate 362 located between the feed line layer 310 and the ground layer 320, and a second substrate 364 located between the ground layer 320 and the third substrate 364.

For an embodiment, the feed line layer 310 includes a conductive fork-shape 311. For an embodiment, the conductive fork-shape 311 includes a conductive handle 312 that is adapted to be electrically connected to a center conductor of a coaxial line. That is, an end portion 315 of the conductive handle 312 extends to an edge of the antenna element, and is electrically connected to a center conductor, thereby connecting the antenna element to electronic circuitry in which wireless signals are transmitted or received through the antenna element.

For an embodiment, the conductive fork-shape 311 additionally includes a conductive cross-section 313 that crosses an end portion (that is, an end portion opposite the end portion 315) of the conductive handle 312.

For an embodiment, the conductive fork-shape 311 additionally includes a plurality of conductive fingers 314, a conductive finger connected to each end portion of the conductive cross-section 313, and a conductive finger 314 connected to a center portion of the conductive cross-section 313.

For an embodiment, a rectangular slot 322 is formed in the ground layer 320, wherein a length of the rectangular slot 322 is perpendicular to the conductive handle 312. That is, the rectangular slot 322 is displaced from the conductive handle 312 by the separation provided by the width of the first substrate 362, but formed so that a length of the slot is perpendicular to the length of the conductive handle 312.

For an embodiment, the third layer 330 includes four parasitic elements 360, wherein each parasitic element 360 is electrically connected to the ground layer 320 through a corresponding shorting via 350.

For an embodiment, electrical signals are applied to the one end portion 315 of the conductive handle 312 of the conductive fork shape 311 of the antenna element. Application of electrical signals to each of a plurality of antenna elements facilitates the formation of direction beams which can be used for directional transmission or reception of wireless signals.

For at least some embodiments, the orientation of the slot is important to maintain the performance of the array. For an embodiment, as shown in FIG. 3, the slot is oriented in an H-plane of the feedline layer 311. A proper orientation allows for effective electromagnetic energy coupling to the parasitic elements 360. Therefore, this orientation operates to increase the radiation efficiency of the overall antenna.

For at least some embodiments, the conductive shorting vias 350 act as monopole antennas. For an embodiment, the conductive shorting vias 350 are spaced equally along the edge of the slot 322 (horizontal) and non-equal in the other direction. For another embodiment, the number of conductive shorting vias 350 can be larger but not less than 4. If a parasitic element is not connected to a conductive shorting via 350, then the parasitic element will not radiate. That is why number of conductive shorting vias 350 should be greater or equal to 4. The spacing between the conductive shorting vias 350 and the number of conductive shorting vias 350 can be adjusted to significantly, reduce the surface wave and element coupling (both unwanted phenomenon) in the array employing them.

For the described embodiments, the conductive cross section 313 should be placed at the end (opposite end of the end portion 315) of the conductive handle 312. The reason is to minimize the perturbation introduce by the conductive cross section 313 to the impedance value of the conductive handle 312. In other words, the widest operating bandwidth of the antenna element wherein the input impedance to the antenna element is maintained at 50 ohms (or some other desired input impedance) is achieved by placing conductive cross section 313 at the opposite end of conductive handle 312 as the end of the connection to the coaxial line.

The conductive cross section 313 plays an important role in the performance of the antenna. For an embodiment, the orientation of the conductive cross-section 313 is perpendicular to the conductive handle 312. The conductive cross-section 313 excites the higher order modes of the parasitic elements 360 that it would not be excited otherwise. These higher order modes are necessary to generate a circularly polarized wave. That is, orientation of the conductive cross-section 313 being perpendicular to the conductive handle 312 aids in the excitation of the higher order modes necessary to generate a circularly polarized wave.

For at least some embodiments, the conductive fingers 314 are complementary to three spaces between each pair of the conductive shorting vias 350, wherein the conductive cross-section 313 is complementary to the space of the last pair of the conductive shorting vias 350. This orientation between the conductive fingers 314 and the conductive shorting vias 350 forms a complementary structure which supplements the broadband performance of the antenna element.

For at least some embodiments, a width of the conductive fork shaped 311 is selected to aid matching of the input impedance of the antenna element to whatever system is electrically connected to the antenna element. For at least some embodiments, the input impedance is dependent on the width of the conductive fork shape 311, the system frequency, the di-electric constant material of the first substrate 362, the thickness of the first substrate 362, the thickness of the metal layer, and the fabrication tolerances of a printed circuit board (PCB) manufacturer of the antenna array of the antenna element. These parameters are set by the manufacturing process and their variation are accommodated in by the antenna element design.

For at least some embodiments, a thickness of the ground conductor (ground layer 320) is dictated by the PCB manufacturer of the antenna element. For an embodiment, the value of the thickness is 0.01 mm±10%.

At high operating frequencies (such as, 57.24 GHz to 65.88 GHz) where the wavelength of the electromagnetic waves is a few mm (which is comparable to the typical PCB manufacturer tolerances capability), the manufacturer tolerances become an important part of the design process. PCB manufacturer tolerance imposes restrictions on the track widths, track thickness, layer thickness, dielectric constant of the substrate, number of the layers, conductive via size and diameter, via layers (i.e., from which layer to what layer they can drill a hole). For an embodiment, these numbers are: track widths larger than 0.15 mm, minimum track thickness 0.01 mm, layer thickness of 0.127 mm±0.01 mm, dielectric constant 3±0.2, number of the layers 6, minimum via size and diameter 0.15 mm. via pairs only from top to bottom layer and from layer 1 (top) to layer 2.

For an embodiment, the feed line layer 311 utilizes an adapter to transient from microstrip feedline of the end portion 315 of the conductive handle 312 to the coaxial connection.

Figure 4:
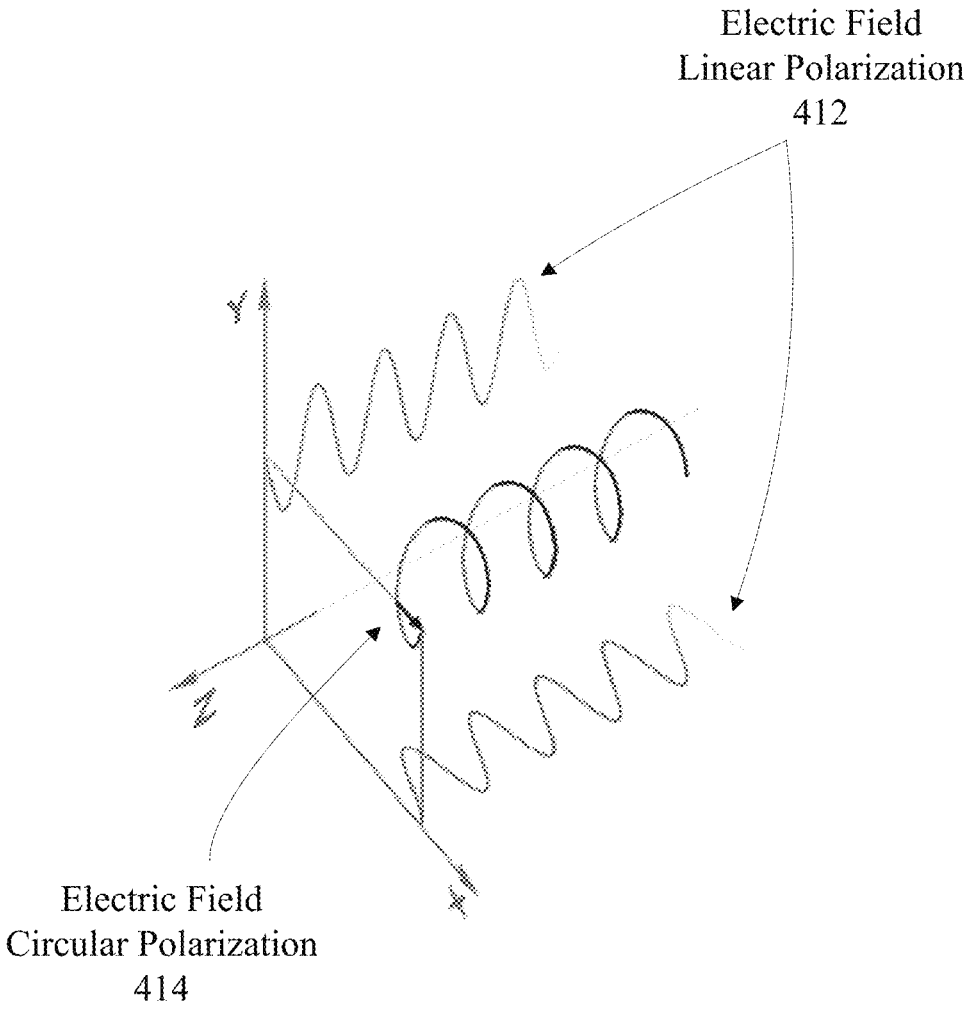
FIG. 4 shows linear polarization electric field oscillations and circular polarization electric field oscillations.

FIG. 4 shows linear polarization electric field oscillations 412 and circular polarization electric field oscillations 414. Electromagnetic waves radiated by an antenna convey a specific polarization. The polarization of an electric field refers to the oscillation of the electrical field over one period at a constant location. The polarization can be linear, circular, or elliptical. In linear polarization, the tip of the electric field traces a line. Similarly, in a circular polarization, the electric field traces a circle. Most of the antennas simply radiate a linear polarization. In order to generate a circularly polarization, several conditions must be satisfied.

Linear polarized waves can be aligned along any axis. For example, if the movement of the electric field is parallel to the surface of the earth, it is called horizontal polarization. Likewise, if the electric field is oscillating perpendicular to the surface of the earth then we have a vertical polarization. In order to receive a signal with a specific polarization, the receiver antenna must have the exact same polarization. If the polarization of the signal and the antenna is not the same, then there will be a polarization mismatch. The polarization mismatch can completely block the reception of the signal. For instance, a vertical polarized antenna does not receive a horizontal polarized signal. Linear polarization depends on the orientation of the antenna. In other words, a vertical polarization can become a horizontal polarization by simply rotating the antenna by 90 degrees. The orientation dependency of polarization is not favorable in many wireless applications because the established link is prone to blockage due to polarization mismatch.

Circular polarization (CP) waves, on the other hand, are independent of the orientation of the antenna. CP waves have immunity against polarization mismatch. Despite their benefits, CP antennas are truly difficult to be realized over a large bandwidth (larger than 2% relative bandwidth).

An antenna array that includes the described antenna elements provides CP electromagnetic waves over large bandwidths. This is achieved, at least in part, due to the relatively low coupling between antenna elements of an antenna array that includes the described antenna elements.

Figure 5:
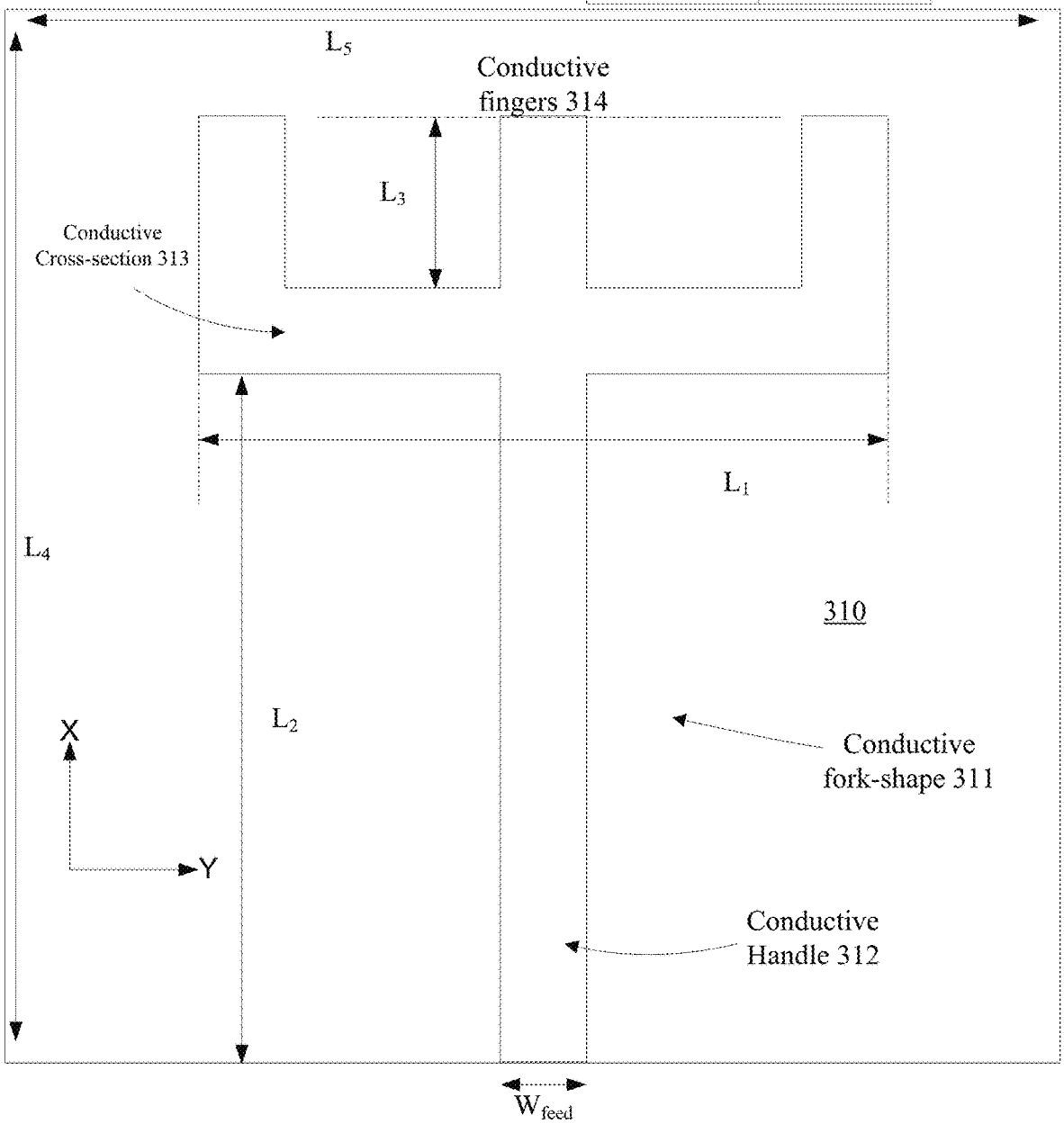
FIG. 5 shows a top-view of a feed line layer, according to an embodiment.

FIG. 5 shows a top-view of a feed line layer 310, according to an embodiment. For at least some embodiments, the dimensions of the features of the antenna element are selected based at least in part on the frequencies of the electromagnetic signals transmitted and/or received through the antenna element. As included within a table 510 of FIG. 5, at least some dimensions of the features of the antenna element are dependent upon the wavelengths ($\lambda$) of the electromagnetic signals that propagate through the antenna element. At least some definitions include:

$\lambda_0$: the wavelength of the electromagnetic wave in free space.

$\lambda$: the wavelength of the electromagnetic wave inside the substrate. The dielectric of the substrate depends on the manufacturing process.

For an embodiment, the fingers are equal in length to minimize unwanted higher order mode radiations.

Bandwidth: the highest supported frequency minus the lowest supported frequency.

$\lambda_{mid}$: wavelength at the center of the bandwidth.

$\lambda_{min}$: wavelength at the highest frequency.

$\lambda_{max}$: wavelength at the lowest frequency.

As previously described, for at least some embodiments, the conductive fork-shape 311 of the feed line layer 310 includes a conductive handle 312 adapted to be electrically connected to a center conductor of a coaxial line. Further, as depicted, the dimensions of the conductive handle 312 are selected such that the length of the conductive handle 312 is L2, wherein L2 is $(\lambda_{min})/2$. Further, for at least some embodiments, a width of the conductive handle 312 is $W_{feed}$, wherein $W_{feed}$ is based at least in part on the center conductor the coaxial line that the conductive handle 312 is electrically attached. For an embodiment, $W_{feed}$, is selected to be 0.3 mm (millimeters) plus or minus 10%.

It is to be understood that formation of the different conductive elements of the antenna element are subject to fabrication processing tolerances. That is, none of the specified dimensions can be exact due to processing tolerances.

As previously described, for at least some embodiments, the conductive fork-shape 311 of the feed line layer 310 includes a conductive cross-section 313 that crosses an end portion of the conductive handle 312. For an embodiment, the conductive cross-section 313 is selected to have a length L1, wherein L1 is $(\lambda_{min})/2$.

As previously described, the conductive cross section 313 is placed at the end of the conductive handle 312 to minimize perturbations introduce by the conductive cross section 313 to the input impedance value of the conductive handle 312, and therefore, of the antenna element. Further, as previously described, for an embodiment, the orientation of the conductive cross-section 313 is perpendicular to the conductive handle 312. The conductive cross-section 313 excites the higher order modes of the parasitic elements 360 that it would not be excited otherwise. These higher order modes are necessary to generate a circularly polarized wave. That is, orientation of the conductive cross-section 313 being perpendicular to the conductive handle 312 aids in the excitation of the higher order modes necessary to generate a circularly polarized wave.

As previously described, for at least some embodiments, the conductive fork-shape 311 of the feed line layer 310 includes a plurality of conductive fingers 314, a conductive finger 314 connected to each end portion of the conductive cross-section 313, and a conductive finger 314 connected to a center portion of the conductive cross-section 313. For an embodiment, the conductive fingers 314 are selected to have a length L3, wherein L3 is $(\lambda_{min})/8$.

As previously described, for at least some embodiments, the conductive fingers 314 are complementary to three spaces between each pair of the conductive shorting vias 350, with a space of the fourth pair being complemented by the conductive handle 312. This orientation between the conductive fingers 314 and the conductive shorting vias 350 forms a complementary structure which supplements the broadband performance of the antenna element.

For at least some embodiments, the antenna array and the feed line layer 310 has dimensions of L4 by L5, wherein L4 and L5 have the dimensions of $(\lambda_{mid})/2$.

As previously described, for at least some embodiments, a width of the conductive fork shaped 311 is selected to aid matching of the input impedance of the antenna element to whatever system is electrically connected to the antenna element.

Figure 6:
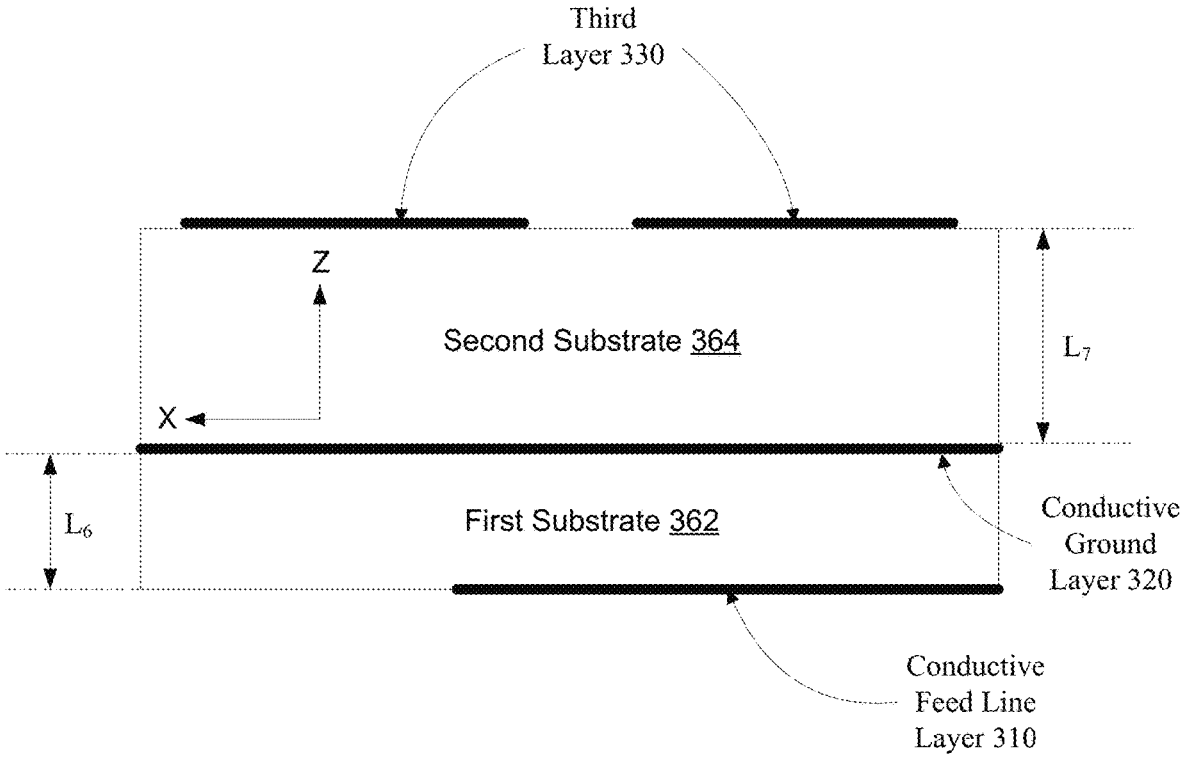
FIG. 6 shows a side-view of an antenna element, according to an embodiment.

FIG. 6 shows a side-view of an antenna element, according to an embodiment. As previously described, the antenna element includes the feed line layer 310, the ground layer 320, and the third layer 330. Further, the antenna element includes the first substrate 362 located between the feed line layer 310 and the ground layer 320, and the second substrate 364 located between the ground layer 320 and the third substrate 364.

For at least some embodiments, the first substrate 362 has a width of $L_6$. For an embodiment, $L_6$ is selected to be $(\lambda_{min})/10$. Further, for at least some embodiments, the second substrate 364 has a width of $L_7$. For an embodiment, $L_7$ is selected to be $(\lambda_{min})/4$. This length ($L_7$) allows the conductive shorting vias 350 to radiate as monopole antennas.

For at least some embodiments, the thickness of each layer is based on the minimum thickness capability of the PCB manufacturer. For example, a tolerance of a PCB manufacturer may be a minimum thickness of 0.127 mm, as such second substrate 364 in FIG. 6 is comprised of 4 of layers glue together to reach 0.508 mm which is $(\lambda_{min})/4$ or $L_7$ in FIG. 6.

Same is true for the first substrate 362. However, $L_6$ is desired to be as small as possible (within the manufacturing capability) to minimize the loss of the dielectric and increase the energy coupling from the conductive fork-shape 311 of the feed line layer 310 to the slot 322 of the ground layer 320.

Figure 7:
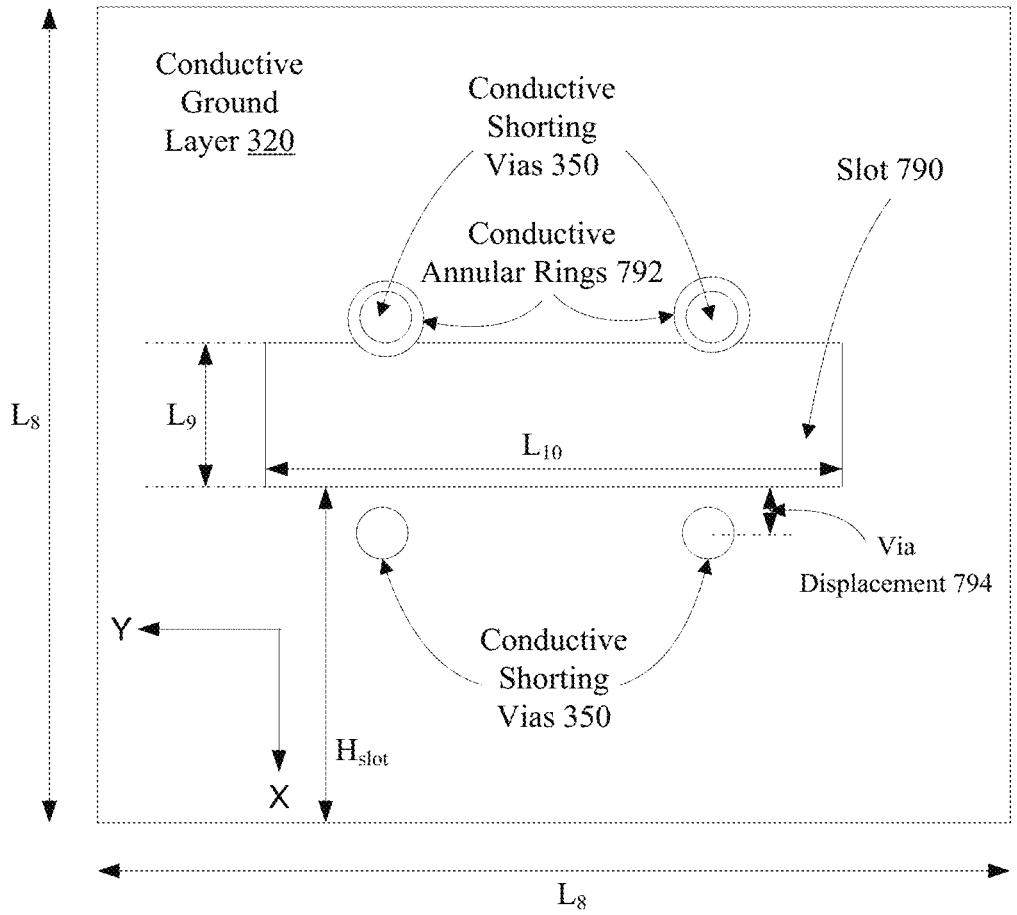
FIG. 7 shows a top-view of a ground layer, according to an embodiment.

FIG. 7 shows a top-view of a ground layer 320, according to an embodiment. As shown, the ground layer 320 includes a slot 790. The slot 790 is formed in the ground layer 320 and includes a slot (no conductive material) through the conductive layer of the ground layer 320. For an embodiment, the slot 790 is shaped as a rectangle. For an embodiment, the rectangle includes a length $L_{10}$ and a width $L_9$. As previously described, for an embodiment, the length $L_{10}$ of the rectangle is substantially perpendicular to a length $L_2$ of the conductive handle 312 of the feed line layer 310.

In general, it is desirable to have all the conductive shorting vias 350 placed separate from the opening of the slot 790. However, the manufacturing processing mandates the conductive annular rings 792 to be placed around the conductive shorting vias 350. For an embodiment, the value of the diameter of the conductive annular rings 792 is 0.278 mm. As such, some parts of the conductive annular rings 792 may obscure the slot 790 and degrade the performance.

It is desirable to have the two of the conductive shorting vias 350 closer to the edge of the slot 790 and to keep the other two conductive shorting vias 350 displaced from the edge by the via displacement 794. As such, by varying a vertical location of the slot as shown by $H_{slot}$, an optimal performance is achieved by making a trade-off between some of the antenna performances such as efficiency and the position of the conductive annular rings 792.

For an embodiment, the slot length L10 is half a wavelength of the operating communication frequency of the antenna element which makes it an effective radiator similar to half-wavelength dipole antennas.

For an embodiment, the length L10 of the slot is selected to be $(\lambda_{min})/2$. Further, for an embodiment, the width L9 of the slot is selected to be $(\lambda_{min})/8$.

For at least some embodiments, the slot 790 is displaced from an edge of the ground plane by a distance of Hslot, wherein Hslot is selected to be $(\lambda_{mid})/2$.

For at least some embodiments, two of the conductive shorting vias 350 physically contact the conductive ground layer 320 adjacent to the slot 790. As shown, two of the conductive shorting vias 350 contact the conductive ground layer 320 through conductive annular rings 792 that protrude over or into the slot 790.

For at least some embodiments, two of the conductive shorting vias 350 physically contact the conductive ground layer 320 displaced from the slot 790 by a via displacement 794.

Figure 8:
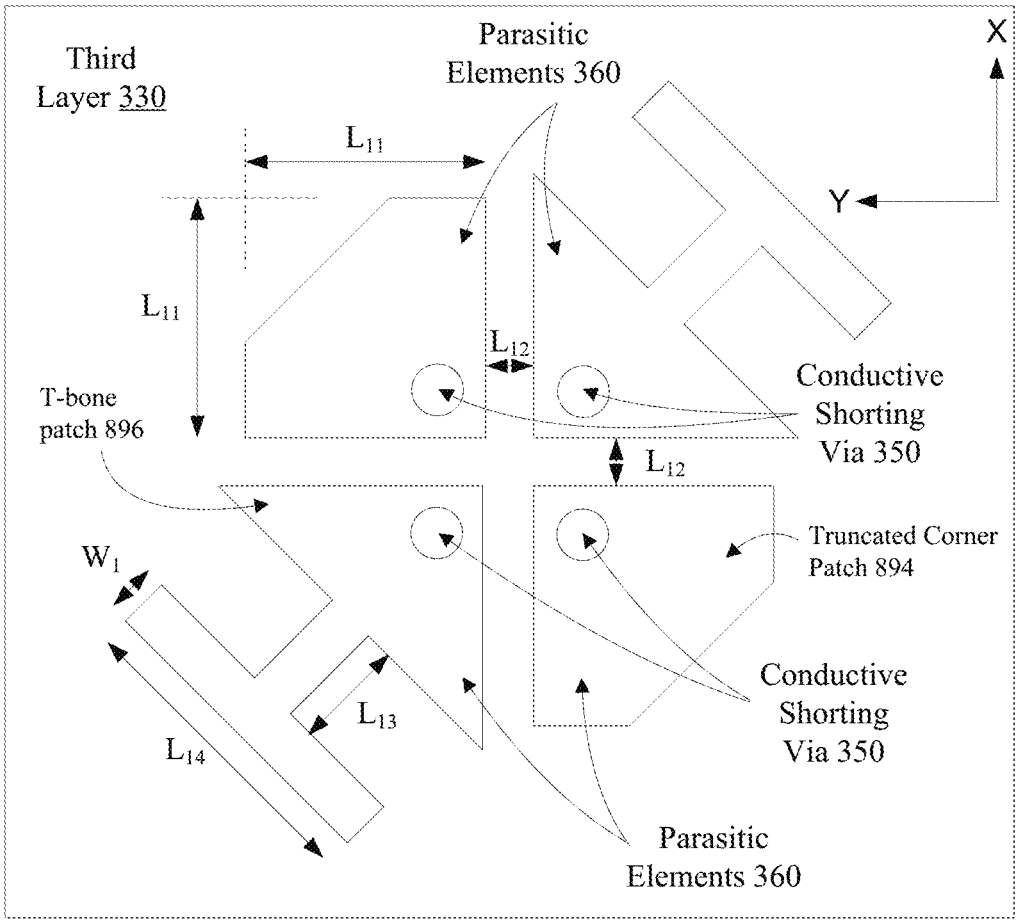
FIG. 8 shows a top-view of a third layer, according to an embodiment.
Figure 9:
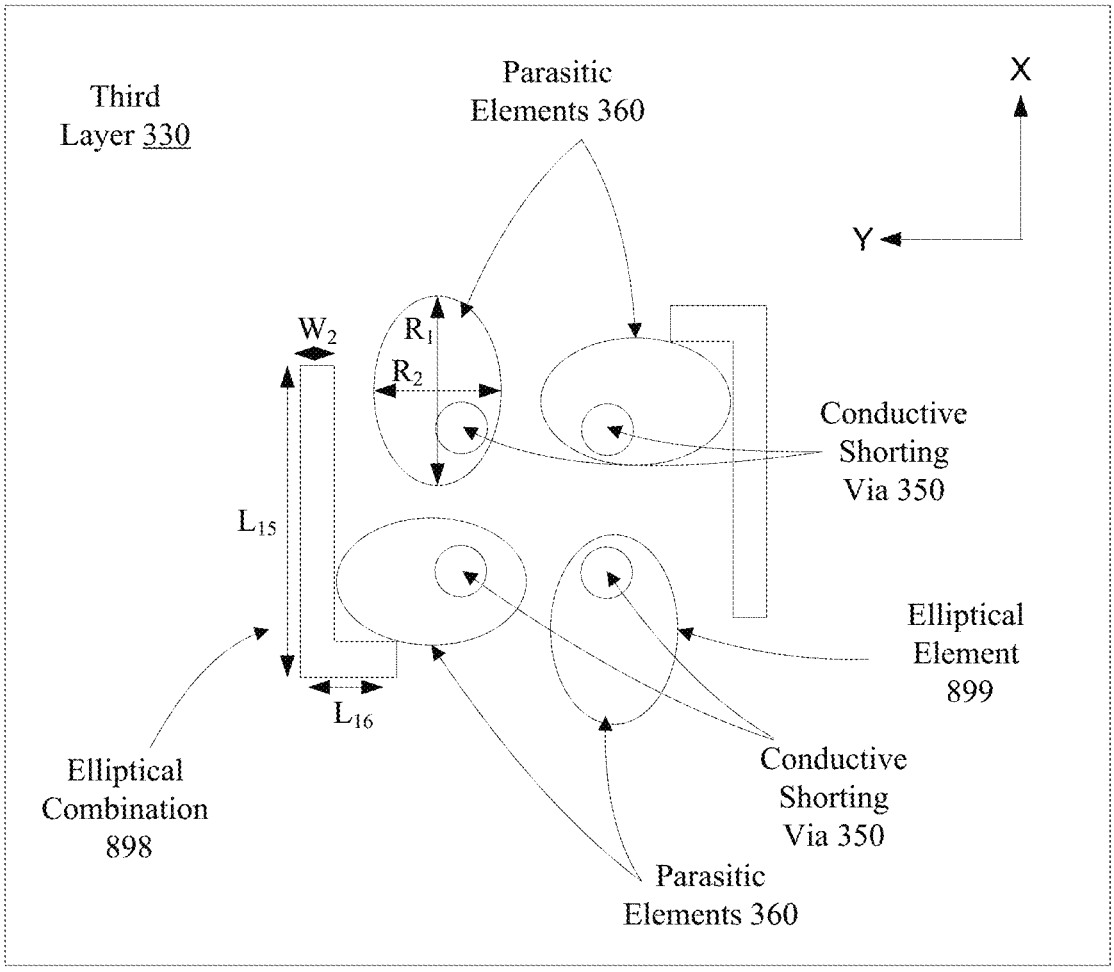
FIG. 9 shows a top-view of a third layer, according to another embodiment.
Figure 10:
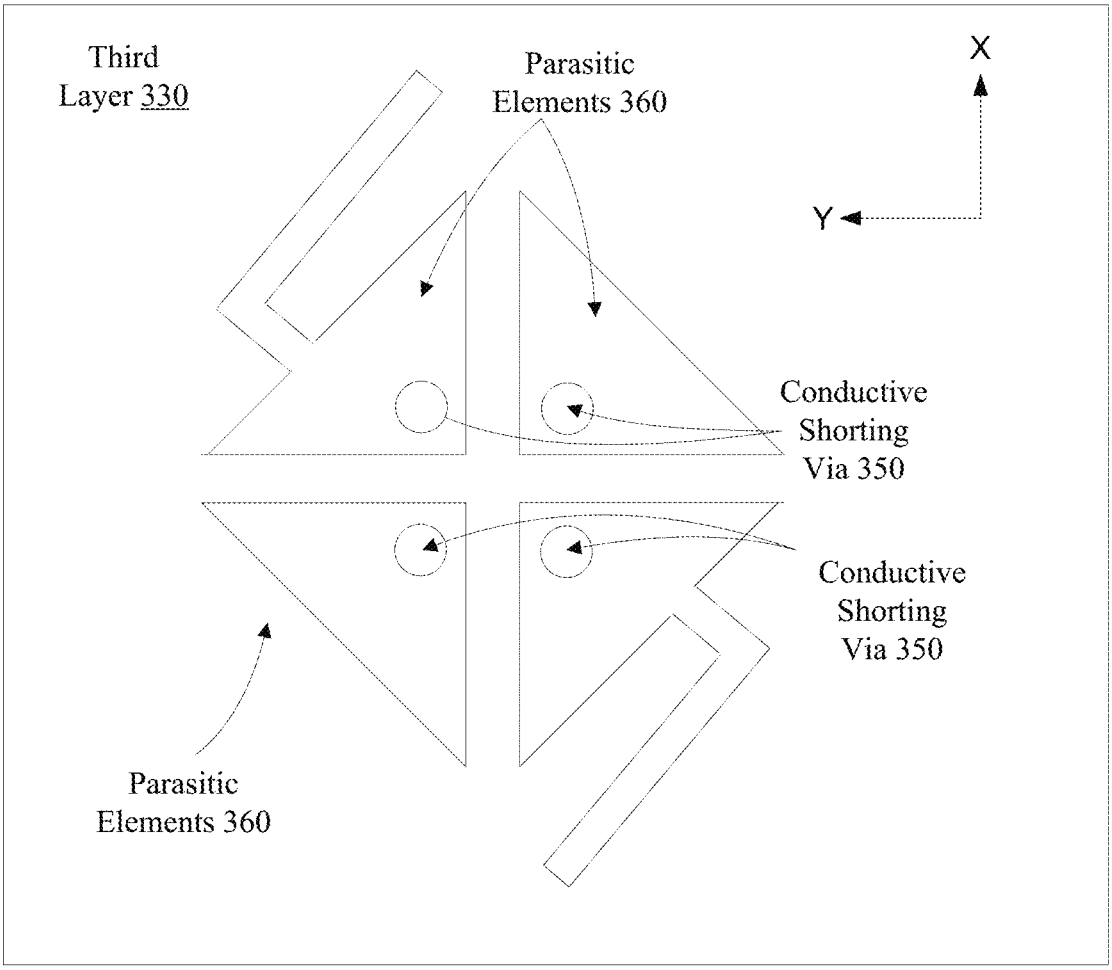
FIG. 10 shows a top-view of a third layer, according to another embodiment.

As shown in FIGS. 8, 9, 10 and in general, some sort of extensions must be added to two of the parasitic elements. For instance, in FIG. 8, a T-shaped conductor, whereas FIGS. 9 and 10 show an L-shaped conductor.

These extensions are necessary to generate a CP waves. For and embodiment, these extensions also provide a necessary 90° phase shift between different electric field components of the parasitic elements.

For an embodiment, the diameter of the conductive shorting vias 350 is 0.15 mm and the diameter of the conductive annular rings 792 is 0.178 mm.

FIG. 8 shows a top-view of a third layer 330, according to an embodiment. As shown, the third layer 330 includes the parasitic elements 360. For an embodiment, two of the parasitic elements include truncated corner patches 894, and two of the parasitic elements include T-bone patches 896.

For an embodiment, each of the two truncated corner patches 894 are formed as approximately squares that are missing a corner. For an embodiment, a length of edges of the square (without the corners removed) is formed to be $L_{11}$, wherein $L_{11}$ is $(\lambda_{max})/2$.

For an embodiment, each of the two T-bone patches 896 are formed as a triangle attached to a T. For an embodiment, a length of a body of the T is formed to be $L_{13}$, wherein $L_{13}$ is $(\lambda_{max})/4$, and a length of a cross-portion of the T is formed to be $L_{14}$, wherein $L_{14}$ is $(\lambda_{max})/4$.

For an embodiment, a width of the cross-portion of the T is W1, wherein W1 is within a range of $(\lambda_{min})/10$ to $(\lambda_{max})/10$.

Corners of each of the two truncated corner patches 894 and T-bone patches 896 form a cross, wherein a width of each portion of the cross have a width of $L_{12}$, wherein $L_{12}$ is $(\lambda_{min})/10$.

As previously described, the conductive shorting vias 350 electrically connect each of the parasitic elements 360 to the conductive ground layer 320.

FIG. 9 shows a top-view of a third layer 330, according to another embodiment. As shown, the third layer 330 includes the parasitic elements 360. For an embodiment, two of the parasitic elements include elliptical elements 899, and two of the parasitic elements include elliptical combinations 898.

For at least some embodiments, the elliptical elements have a larger radius of R1, wherein R1 is $(\lambda_{max})/4$, and the elliptical elements have a smaller radius R2, wherein R2 is $(\lambda_{min})/4$.

For an embodiment, the elliptical combinations 898 include an ellipse having the same dimensions of the elliptical elements, and further include an L-shape, wherein a base portion of the L-shape has a length of L16, wherein L16 is $(\lambda_{min})/8$, and a longer portion of the L-shape has a length of L15, wherein L15 is $(\lambda_{mid})/2$.

FIG. 10 shows a top-view of a third layer, according to another embodiment.

For an embodiment, the frequency of the wireless signals communicated through each antenna element of an antenna array covers a range of 57.24 GHz to 65.88 GHz. For an embodiment, the frequencies include channels 1, 2, 3, 4 of the 802.11ad IEEE standard.

For an embodiment, the antenna array includes a 4×8 array of antenna elements. For an embodiment, the spacing of the antenna elements is 2.50 mm vertically, and 2.50 mm horizontally. For an embodiment, each antenna element includes single-feeds and generate circular polarized electric fields.

For an embodiment, the size of the antenna array is 25 mm×7.5 mm×1 mm, not including a connector height.

For an embodiment, the coverage area of the antenna array is a semi-sphere within $-60$ degrees $<\theta<60$ degrees and 0 degree $<\varphi<360$ degrees while still maintaining circular polarization, wherein $\theta$ and $\varphi$ represent the coverage area in two different planes.

For at least some embodiments, the antenna elements are fabricated using low-quality materials.

As previously described, FIG. 1 shows a transceiver 100 wirelessly communicating with a plurality of different devices 122, 124, 126, according to an embodiment. For an embodiment, the wireless transceiver 100 includes an antenna array 150, a radio 130, and a controller. As previously described, the antenna array operative to form a circular polarized directional beam. The radio is connected to the antenna array. The controller operative to control the reception and transmission of wireless signals wireless signals through the radio and the antenna array. Further, the antenna array includes a plurality of antenna elements. As previously described, for an embodiment, the antenna element includes a feed line layer, a first substrate adjacent to the feed line layer, a ground layer adjacent to the first substrate, a second substrate adjacent to the ground layer, and a third layer adjacent to the second substrate. The feed line layer includes a conductive fork-shape that includes a conductive handle adapted to be electrically connected to a center conductor of a coaxial line, a conductive cross-section that crosses an end portion of the conductive handle, and a plurality of conductive fingers, a conductive finger connected to each end portion of the conductive cross-section, and a conductive finger connected to a center portion of the conductive cross-section. For an embodiment, a rectangular slot is formed in the ground layer, wherein a length of the rectangular slot is perpendicular to the conductive handle. For an embodiment, the third layer includes four parasitic elements, wherein each parasitic element is electrically connected to the ground layer through a shorting via.

Although specific embodiments have been described and illustrated, the embodiments are not to be limited to the specific forms or arrangements of parts so described and illustrated. The described embodiments are to only be limited by the claims.

What is claimed:

1. An antenna element, comprising:

a feed line layer, comprising a conductive fork-shape comprising:

a conductive handle adapted to be electrically connected to a center conductor of a coaxial line;

a conductive cross-section that crosses an end portion of the conductive handle;

a plurality of conductive fingers, a conductive finger connected to each end portion of the conductive cross-section, and a conductive finger connected to a center portion of the conductive cross-section;

a first substrate adjacent to the feed line layer;

a ground layer adjacent to the first substrate, wherein a rectangular slot is formed in the ground layer, wherein a length of the rectangular slot is perpendicular to the conductive handle;

a second substrate adjacent to the ground layer;

a third layer adjacent to the second substrate, the third layer comprising four parasitic elements, wherein each parasitic element is electrically connected to the ground layer through a shorting via.

2. The antenna element of claim 1, wherein wireless signals are communicated through the antenna element having a maximum wavelength of λmax, a minimum wavelength of λmin, and a center wavelength of λmid.

3. The antenna element of claim 2, wherein a length of the conductive handle is within a manufacturing tolerance of (λmin)/2.

4. The antenna element of claim 2, wherein a length of the conductive cross-section is within a manufacturing tolerance of (λmin)/2.

5. The antenna element of claim 2, wherein a length of each of the plurality of conductive fingers is within a manufacturing tolerance of (λmin)/8.

6. The antenna element of claim 2, a width of the first substrate is within a manufacturing tolerance of (λmin)/10.

7. The antenna element of claim 2, a width of the second substrate is within a manufacturing tolerance of (λmin)/4.

8. The antenna element of claim 1, wherein a width of the conductive handle is selected based on an output impedance of the coaxial line.

9. The antenna element of claim 1, wherein the length of the slot is within a manufacturing tolerance of (λmin)/2.

10. The antenna element of claim 1, wherein a width of the slot is within a manufacturing tolerance of (λmin)/8.

11. The antenna element of claim 1, wherein a width and length of the antenna element is within a manufacturing tolerance of (λmid)/2.

12. The antenna element of claim 1, wherein the antenna element is one of a plurality of antenna elements that form an antenna array.

13. The antenna element of claim 12, wherein the antenna array includes a single-feed circular polarization antenna array.

14. The antenna element of claim 13, wherein a conductive handle each antenna element of the antenna array is electrically connected to the single-feed of the circular polarization antenna array.

15. The antenna element of claim 1, wherein two of the four parasitic elements of the third layer comprise truncated corner patches, wherein inside edges of the truncated corner patches have lengths within a manufacturing tolerance of (λmax)/2.

16. The antenna element of claim 1, wherein two of the four parasitic elements of the third layer comprise triangular t-bone patches, wherein a width and a length of a T of the triangular t-bone patches are within a manufacturing tolerance of (λmax)/4.

17. The antenna element of claim 1, wherein the parasitic elements comprise elliptical patches, wherein a larger radius of the elliptical patches is within a manufacturing tolerance of (λmax)/4, and a smaller radius of the elliptical patches is within a manufacturing tolerance of (λmin)/4.

18. The antenna element of claim 17, wherein the elliptical patches of two of the four parasitic elements have a larger radius rotated 90 degrees relative to the smaller radius of the other two of the four parasitic elements.

19. The antenna element of claim 1, wherein the shorting via of two of the parasitic elements are electrically connected to annular rings of the ground layer directly adjacent to the slot, and two of the parasitic elements are electrically connected to the ground layer not directly adjacent to the slot.

20. An antenna array, comprising;

a plurality of antenna elements organized into rows and columns, each antenna element comprising:

a feed line layer, comprising a conductive fork-shape comprising:

a conductive handle adapted to be electrically connected to a center conductor of a coaxial line;

a conductive cross-section that crosses an end portion of the conductive handle;

a plurality of conductive fingers, a conductive finger connected to each end portion of the conductive cross-section, and a conductive finger connected to a center portion of the conductive cross-section;

a first substrate adjacent to the feed line layer;

a ground layer adjacent to the first substrate, wherein a rectangular slot is formed in the ground layer, wherein a length of the rectangular slot is perpendicular to the conductive handle;

a second substrate adjacent to the ground layer;

a third layer adjacent to the second substrate, the third layer comprising four parasitic elements, wherein each parasitic element is electrically connected to the ground layer through a shorting via.

* * * * *